United States Patent [19]

Kusiak et al.

[11] Patent Number: 4,913,620

[45] Date of Patent: Apr. 3, 1990

[54] CENTRIFUGAL WATER PUMP

[75] Inventors: James L. Kusiak, Grand Rapids; John E. Seevers, Ada, both of Mich.

[73] Assignee: Attwood Corporation, Lowell, Mich.

[21] Appl. No.: 206,530

[22] Filed: Jun. 14, 1988

Related U.S. Application Data

[63] Continuation-in-part of Ser. No. 28,870, Mar. 23, 1987, abandoned.

[51] Int. Cl.[4] ..... F04D 7/00

[52] U.S. Cl. ..... 415/211.1; 415/182.1; 415/204; 415/206; 415/169.1

[58] Field of Search ..... 415/209, 203, 204, 206, 415/207, 213 R, 219 A, 219 B, 219 C, 219 R

[56] References Cited

U.S. PATENT DOCUMENTS

| | | | |
|---|---|---|---|
| 1,211,767 | 1/1917 | Schroder | 415/210 |
| 1,625,898 | 4/1927 | Hollander | 415/197 |
| 1,795,588 | 3/1931 | Wilson | 415/210 |
| 1,981,991 | 11/1934 | Cline | 415/210 |
| 2,015,200 | 9/1935 | Spoor | 411/379 |
| 2,945,448 | 7/1960 | Frederick | 415/53 R |
| 2,951,449 | 9/1960 | VanBlarcom | 415/53 R |
| 3,113,593 | 12/1963 | Vicard | 415/209 |
| 3,205,828 | 9/1965 | Rupp | 415/199.1 |
| 3,244,105 | 4/1966 | La Flame | 415/143 |
| 3,246,605 | 4/1966 | Fisher | 415/206 |
| 3,289,598 | 12/1966 | Buse | 415/209 |
| 3,823,063 | 7/1974 | Callahan | 162/212 |
| 3,871,789 | 3/1975 | Laméris | 415/209 |
| 3,873,231 | 3/1975 | Callahan | 415/211 |
| 3,918,829 | 11/1975 | Korzec | 415/119 |
| 4,057,361 | 11/1977 | Renaud | 415/53 R |
| 4,153,385 | 5/1979 | Riefenthaler | 415/53 R |
| 4,401,409 | 8/1983 | Torbica | 415/211 |

FOREIGN PATENT DOCUMENTS

| | | | |
|---|---|---|---|
| 804065 | 4/1951 | Fed. Rep. of Germany | 415/219 C |
| 3517498 | 11/1986 | Fed. Rep. of Germany | 415/206 |
| 3862232 | 1/1923 | United Kingdom | 415/204 |

*Primary Examiner*—Robert E. Garrett
*Assistant Examiner*—Therese M. Newholm
*Attorney, Agent, or Firm*—Price, Heneveld, Cooper, DeWitt & Litton

[57] ABSTRACT

A centrifugal water pump especially adapted for fish and live bait live wells in which the pumping chamber is horizontally oriented and such chamber has two wall portions or sectors of different radii, one wall portion having a radius substantially the same as the outermost radial path of the impeller blades of the impeller and the other wall portion being substantially greater, such wall portions being connected by spaced walls, one of the walls being located immediately adjacent the upwardly extending passageway of the outlet of the pump. In the preferred embodiment, a divider wall is located and extends longitudinally in the passageway of said outlet dividing said passageway into two passageways.

30 Claims, 2 Drawing Sheets

CENTRIFUGAL WATER PUMP

This invention relates to a centrifugal water pump and more particularly to a centrifugal bilge pump and so-called through-transom live-well pump for live bait and fish.

This application is a continuation-in-part of U.S. Patent Application Ser. No. 07/028,870 filed Mar. 23, 1987, now abandoned, by applicant James A. Kusiak and assigned to Attwood Corporation, assignee of the present application.

BACKGROUND OF THE INVENTION

It is the common practice to carry live bait and live caught fish in tanks which are mounted or built into the boat. However, live bait and fish cannot be kept alive in stale uncirculated water for any extended period of time because the water will become deoxygenated and/or fouled causing the bait or fish to die. Therefore, in order to maintain maximum life of the bait and the fish, live well support systems have been developed to both recirculate and oxygenate water in the tank. In addition to the tank position in the boat, centrifugal pumps are provided for pumping water from outside of the boat into the tank and the tank has an overflow allowing water to drain out of the tank. Typically, the pumping means includes a through-transom fitting mounted in the boat transom below the normal water line and the pump is mounted inside the boat on a fitting with a hose leading from the pump to the tank. The fitting is generally mounted above the planing surface so that there is no drag and it draws fresh water from outside the hull.

Additionally, many boats contain bilge pumps for the purpose of pumping accumulated water from the boat. Typically, such a bilge pump is mounted at or near the lowest point of the transom or hull of the inside of the boat. A through-hull or -transom fitting is mounted in the hull or transom below the water line and a hose leads from the pump to the fitting. When the pump is activated, water is drawn from the bilge through the pump and forced out of the boat through the hose and fitting.

The pumps generally used in the above two systems are centrifugal pumps having a circular chamber and a rotary impeller positioned therein. With the live well pumps, if the supply of water is not adequate, such as when the water intake fitting rises above the water level outside of the boat when the boat is planing or when rough water causes the fitting to be exposed to the air, the pump becomes air locked and is unable to continue pumping water. The pump remains air locked and the impeller is unable to pump water so long as the impeller is being driven because it just keeps recirculating the same air. It is believed this results in a donut shaped air bubble that encompasses the impeller blades.

An air lock is most typically cleared by turning the pump off thus releasing the back pressure of the air and allowing the water in the pump outlet hose to fall back through the pump, forcing the trapped air out of the chamber. The pump is then restarted permitting the impeller blades to return to normal pumping of the water. Alternatively, if the live well fitting is mounted in the boat transom, the boat may be driven rapidly in reverse forcing water into the fitting and the pump chamber, clearing the air lock. Both of these methods are cumbersome and impractical because they first require the boat operator to discover that the pump has been air locked and then to take one of the above actions to correct the problem.

One pump that has addressed this air lock problem is disclosed in pending U.S. Patent Application Ser. No. 561,587 filed on Dec. 14, 1983, now abandoned. This pump is of the type in which the chamber is oriented in a vertical direction and having an inlet opening at the bottom thereof with an outlet port mounted upwardly above the impeller. This pump has successfully corrected the problem or air lock by providing a plurality of spaced vanes circumferentially mounted around the impeller blades. These blades cut into the air pocket as the impeller blades are rotated causing turbulence that breaks up the air pocket. However, for many uses the upwardly extending housing required for this type of centrifugal pump is undesirable because of the space it occupies. Therefore, there has been a need for a low profile pump, i.e., one in which the cylindrical chamber is mounted on the horizontal rather than on the vertical. This orientation of the chamber presents entirely new problems that cannot be solved by a plurality of baffles or blades mounted circumferentially about the impeller blades and, therefore, to my knowledge no low profile centrifugal pump with a chamber arranged on the horizontal has existed to date.

SUMMARY OF THE INVENTION

In accordance with this invention, I have designed a low profile centrifugal water pump in which the problem of air lock has been eliminated. This air pump has a cylindrical chamber mounted on the horizontal and having a rotatable impeller mounted within the chamber. The chamber has an inlet supported at one end and the driving means for the impeller located at the other end. A passageway means leading to an outlet port extends upwardly from the chamber. The impeller has a plurality of blades positioned in the chamber and rotatably mounted therein about an axis extending along the same general direction as the inlet and chamber. The novelty in this pump resides in providing two chamber wall portions having different radii. One wall portion is of greater radius than the outermost radial path of the impeller blades and the other wall portion has a radius substantial equal but slightly greater than the radius of the radial path of the impeller blades. Connecting the two chamber wall portions are terminal walls, one of which is located adjacent the outlet port on the side thereof in the direction of rotation of the impeller blades. Thus, this wall directs the pumped water upwardly into the outlet port. The other connecting wall is located a sufficient distance from the first deflecting wall so as to fill any space wherein air or air bubbles could collect and adversely affect the operation of the pump.

Within a narrower aspect of this invention a divider wall is located within the passageway means to form two passageways. This wall assists in the escape of the air of the air pockets broken up by the terminal walls.

This novel construction provides a low profile pump which eliminates the need to worry about the pump becoming air locked since the deflecting wall located adjacent the outlet port breaks up the air and air bubbles forming the air lock, directs the water upwardly into the outlet port and fills up that place where the air and air bubbles are prone to collect.

The above objects, advantages and features of the invention will become more fully understood and appreciated by reference to the following written specification and appended drawings.

DESCRIPTION OF THE PREFERRED EMBODIMENT

Figure 1:
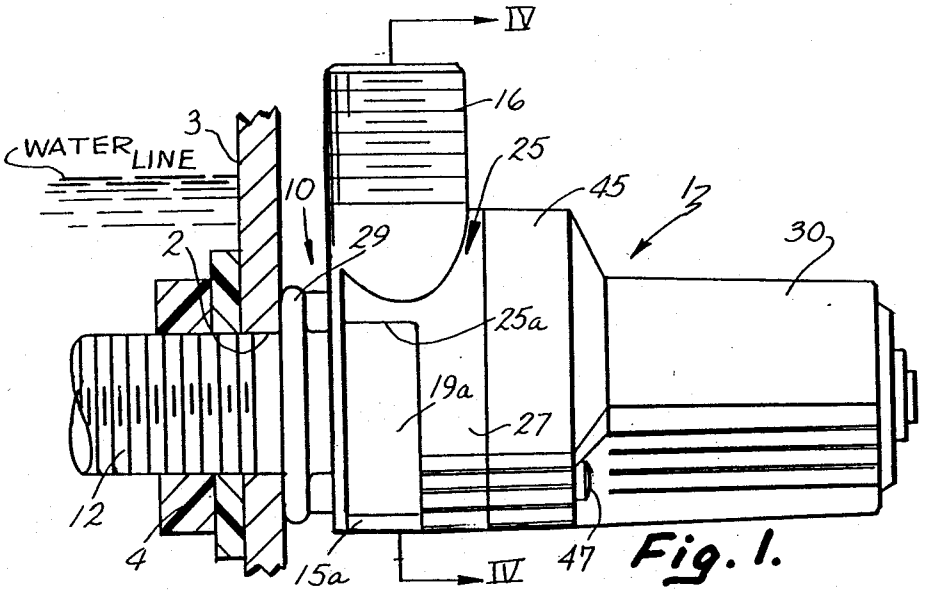
FIG. 1 is a side elevational view of the pump of the present invention illustrating the horizontal orientation of the pump.
Figure 2:
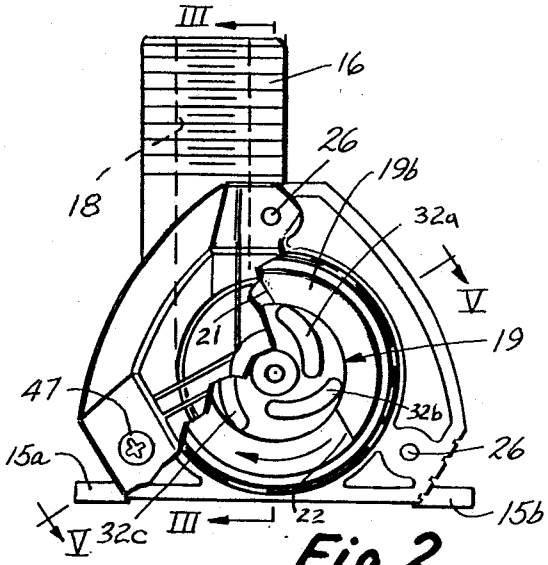
FIG. 2 is an end elevational view of the pump of the present invention with portions cut away to illustrate certain features of the invention.
Figure 3:
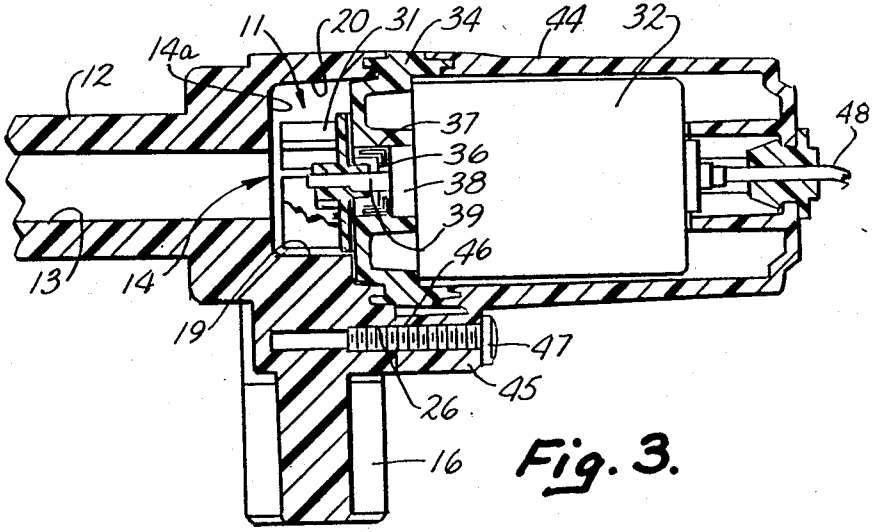
FIG. 3 is a cross-sectional view of FIG. 2 taken along the plane III—III of FIG. 2.

Reference is made to FIGS. 1–4 in which reference numeral 1 designates the pump of this invention which includes a chamber housing subassembly 10 and a motor and impeller subassembly 30. The chamber housing subassembly includes a chamber 11 in which is rotatably mounted the impeller 31 driven by the motor 32. A through-transom inlet fitting 12 extends from one end of the chamber 11 through transom opening 2 of transom 3 providing means for the water to be drawn into the chamber 11 through the passageway 13 and inlet port 14 (FIG. 3). As disclosed in FIGS. 1 and 3, the inlet passageway 14 and the chamber 11 are adapted to be horizontally mounted and for that purpose the flanges 15*a* and 15*b* (FIG. 2) are provided. A discharge pipe or outlet 16 includes a passageway 18 extending upwardly from the pump chamber 11 and an outlet port 17 (FIG. 4) offset from the central axis of the chamber 11. Thus, water is drawn by the impeller 31 through the passageway 13, inlet port 14 and chamber 11 and then forced outwardly out of the outlet port 17 through passageway 18.

A divider wall 23 is located in passageway 18 of discharge pipe 16 to assist in the escape of air from chamber 11 as will be explained hereinafter. Wall 28 extends the entire length of passageway 18 and is oriented to extend laterally across passageway 18 in a direction which corresponds to the direction in which the axis of chamber 11 and inlet fitting 12 extend. In other words, one face 28*a* of wall 28, as disclosed in FIG. 4, faces the direction of rotation of impeller 31.

Figure 4:
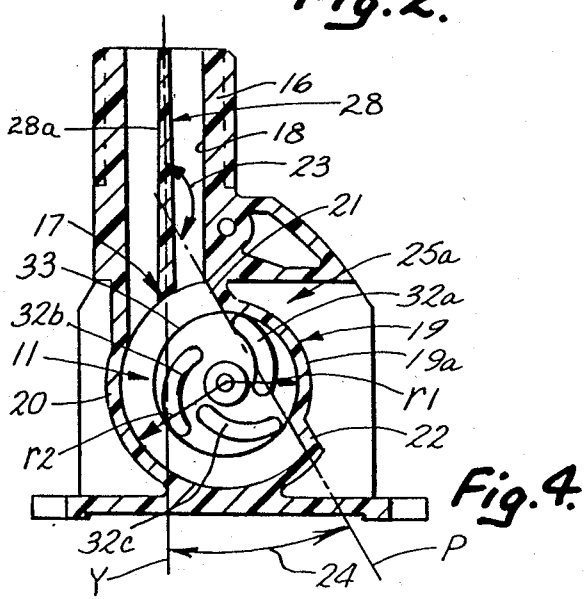
FIG. 4 is a cross-sectional view taken along the plane IV—IV of FIG. 1.

One of the important aspects of this entire invention is the shape of the walls of the chamber 11 as disclosed in FIGS. 2, 3 and 4. As clearly shown in FIGS. 2 and 3, two wall portions 19 and 20 are provided. Wall portion 19 forms an arc having a radius $r_1$ whereas the wall portion 20 has a greater radius $r_2$. As disclosed in FIG. 4 and also shown in FIG. 2, radius $r_1$ is substantially equal to the radius of the outermost radial path 33 of the impeller blades 32*a*, 32*b* and 32*c* of the impeller 31, the radius $r_1$ is sufficiently large to permit the blades 32*a*, 32*b* and 32*c* to freely rotate within the chamber 11. The radius $r_2$ is of substantially greater length leaving a space between the arcuate wall portion 20 and the outermost radial path 33 of the blades 32*a*, 32*b* and 32*c*. The arcuate walls 20 and 19 terminate at and are connected by the terminal walls 21 and 22. Wall 22 is located at an angle of at least ninety degrees (90°) from wall 21 although it is preferred these walls are located on the plane "P" which intersects the vertical at an obtuse angle 36 of 150° and the acute angle 37 at 30°. Within a more narrow aspect of this invention, this angle was discovered to the optimum angle for greatest efficiency of the pump.

The wall 21 is located immediately adjacent the outlet port 17 on the side thereof in the direction of rotation of the impeller blades, it being understood that the impeller blades rotate in a clockwise direction as indicated by the arrows in FIG. 2 and 4. This position of the wall 21 serves the function of directing water directly upwardly out of the port 17 and through the passageway 18 of the outlet pipe 16.

It is believed that the location of the wall 22 is most efficient because it provides for the optimum quantity of water to be drawn into the chamber 11 while at the same time eliminating the amount of space in which air can collect and adversely affect the pumping action of the pump.

Figure 5:
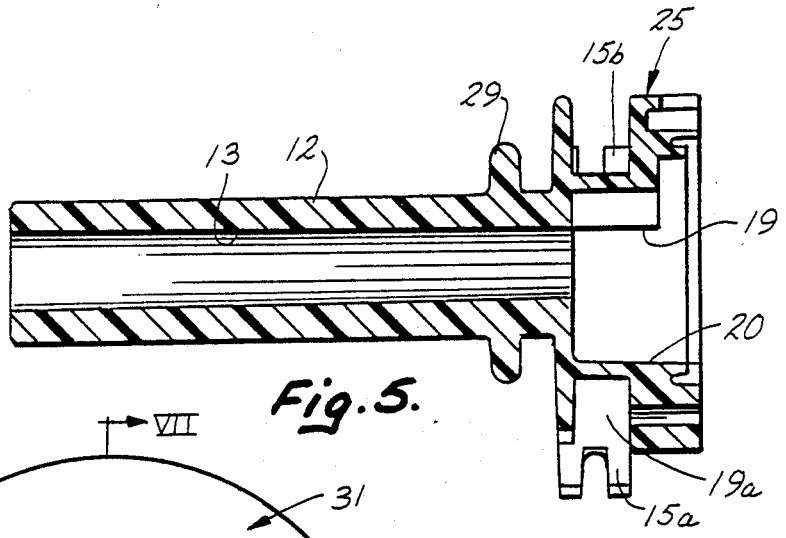
FIG. 5 is a cross-sectional view of the chamber part of the pump taken along the plane V—V of FIG. 2.

The wall portion 19 is formed in part by a solid protrusion extending into the chamber 11 as illustrated in FIGS. 2 and 5. In order to conserve material, the housing 25 is cut away at 25*a* forming a thinner wall 19*a* whereas the protrusion 19*b* of wall 19 protrudes radially inwardly as disclosed in FIGS. 2 and 5.

Figure 6:
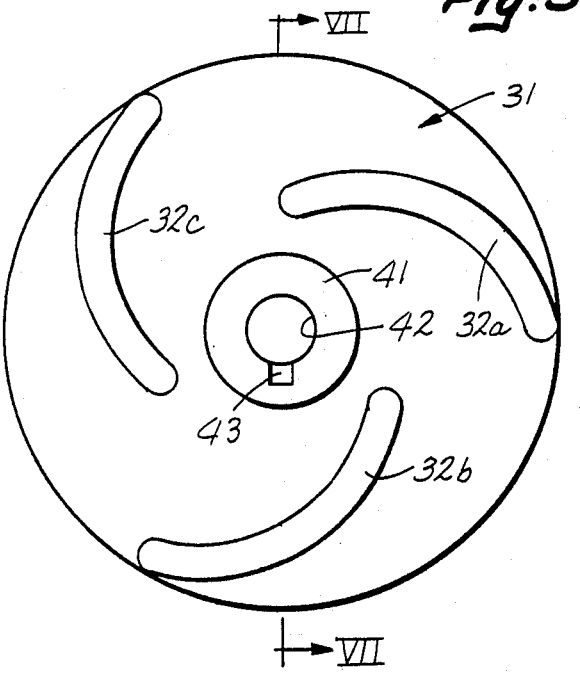
FIG. 6 is an end view of the impeller utilized in this invention.
Figure 7:
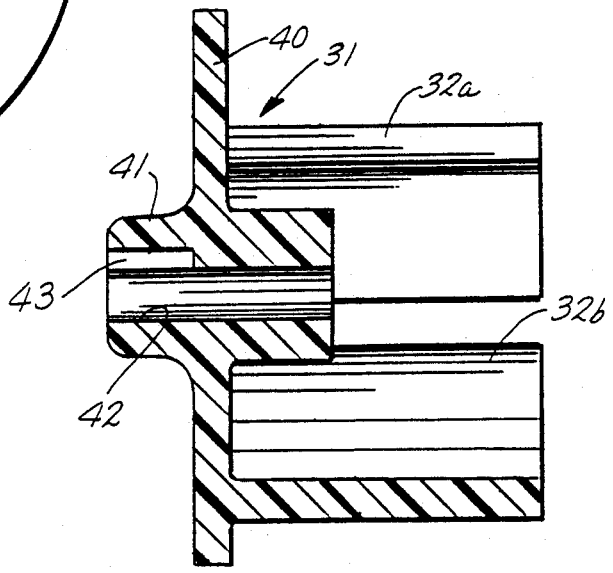
FIG. 7 is a side elevational view of the impeller utilized in this invention.

The motor and impeller subassembly 30 includes the end cap 34 mounted on the housing 25 of the chamber subassembly. A seal 36 to prevent water from entering the motor chamber is mounted in a central opening 37 of cap 34 receives the protruding end 38 and the drive shaft 39 of the motor 32 on the end of which is mounted the impeller 31. Impeller 31 is a molded member formed of the disc like part 40, hub 41 and three arcuate blades 32*a*, 32*b* and 32*c* extending from the disc part 40. The blades 32*a*, 32*b* and 32*c* are all spaced one from the other providing a central opening between them into which the water is drawn through the port 14 and centrifugally thrown radially outwardly by the blades 32*a*, 32*b* and 32*c*. The shaft 39 is received in the bore 42 which includes a key slot 43 (FIGS. 6 and 7).

A motor housing 44 is mounted on the cap 34 opposite the chamber subassembly. It includes the flange 45 having three openings such as disclosed at 46 in FIG. 3 and receiving the bolt 47 which is threadedly received in the threaded openings 26 of the chamber subassembly's flange 27.

When assembled as shown in FIG. 3, the ends of the impeller blades are located a distance from wall 14 providing a space between 14*a* and the ends of the blades, which it is believed is a major cause of air lock. The reason for this is that in this type of pump the sales price does not permit close tolerances between the wall 14*a* and the end of the impeller blades. It is believed that if there is any air or air bubbles in the passageway 13, the impeller will draw the air into the central opening and then recirculate it through the space between the wall 14*a* and the impeller blades which creates a donut shaped air pocket surrounding a substantial portion of the blades, causing air lock. The configuration of the walls 19 and 20 substantially minimizes if not eliminates such air lock. Air lock is also believed to occur by reason of air being located in the hose (not shown) leading from the discharge pipe to the live-well. Such air frequently has no escape route by reason of water lying in a low spot of the hose. Thus the air backs up into the chamber thereby accentuating the problem.

OPERATION

Pump 10 is installed on a boat by inserting the threaded pipe or fitting 12 through aperture 2 in the transom 3 of the boat with the flange 29 abutting against the interior of the transom. Nut 4 is then threaded onto the threads of the pipe 12 and tightened against the exterior of the transom. The input leads 48 for the motor are connected to a power source (not shown). The motor 32 drives the shaft 39 and impeller 31. In normal operation, the centrifugal impeller 31 draws water through the port 14 and forces water upwardly through the outlet or discharge pipe 16 which is connected to a tube leading to the aerator head for the live bait tank.

Occasionally the inlet pipe 12 will rise out of the water when the boat is planing or rocking in the waves. This subjects the passageway 13 to the air creating an air lock in the chamber 11. The pump 10 can become air locked also when air bubbles in the water outside of the boat are drawn into the chamber 11. As previously stated, several theories have been expressed as to the reason for the air lock. One such theory is that the air is drawn into the central opening between the blades 32*a*, 32*b* and 32*c* and then recirculated through the space between wall 14*a* forming the port 14 and the end of the blades causing a donut shaped air pocket to form around the blades. Further, in this type of centrifugal pumps wherein the pumping chamber is mounted on the horizontal, the space between the outermost radial path 33 of the impeller blades and the walls leaves a substantial volume of space in which air can collect and move with the blades as they are rotated, thus failing to effect any real pumping action. Even if the pump is pumping some water, this space between the walls and the radial path of the impeller blades provides a place where air bubbles will tend to stay, thus adversely affecting the pumping action of the pump.

In accordance with this invention, the two wall portions 19 and 20 of different radii are provided to provide the wall 21 immediately adjacent the outlet port where the air bubbles can be broken or chopped up in order to mix the air with the water that is present. Further, this wall 21 immediately adjacent the outlet port 17 is slanted so as to direct any mixture of air and water upwardly through the passageway 18.

Wall 19 formed by the protrusion 19*b* and the thin wall 19*a* fills up a substantial space along the walls of the pumping chamber which minimizes spaces where bubbles will collect and stay. On the other hand, I have discovered that if the length of the chord formed by the wall 19 is too long, the amount of water that the pump can pump is substantially reduced which has an adverse affect upon the pumping action of the pump when there is plenty of water available and no air is present. It was discovered that the optimum location for the wall 22, which determines the length of the chord formed by the wall 19, is where a line drawn through the walls 21 and 22 intersect the vertical at an obtuse angle 23 of 150° and an acute angle 24 at 30°. The reason why this is believed to be that there is still sufficient space in the chamber 11 for an adequate volume of water to be pumped while at the same time the space in which any air can collect and stay is reduced to a minimum.

Divider wall 28 also assists in accelerating the breakup of air lock by permitting the air resulting from the broken up air pockets to escape from the impeller chamber 11 and allowing the flow of water into the chamber 11. It is believed such action can be likened to the affect created by a knife being inserted into the neck of a catsup bottle which permits flow of air in one direction on one side of the knife and the flow of catsup in the other direction on the other side of the knife. The divider wall creates a positive and negative pressure as opposed to normal flow of water thereby actually reversing the flow of water remaining in the outlet passageway on one side of the wall, allowing water in one of the outlet passageways to flow back into the impeller chamber. Air is then forced out of the impeller chamber and through the other outlet passageway on the opposite side of wall 28.

In accordance with this invention, the pump can automatically rid itself of air lock. Thus, constant monitoring for the presence of air lock so that corrective action can be taken is eliminated or reduced to a minimum. Although I have described the pump of this invention in conjunction with live wells keeping live bait and fish alive, the pump may be used equally as well as a bilge pump system which is also extremely important in that the air lock of a pump can cause a leaking boat to sink as a result of the inability of the bilge pump to pump the water out of the bilge. Further, it is also contemplated that this pump may be used in many other environments.

It should be understood that although the preferred embodiment of this invention has been described, various changes and alterations can be made without departing from the spirit and broader aspects of the invention as set forth in the appended claims. Therefore, this invention shall be limited only as defined by the appended claims and the equivalents thereof.

The embodiments of the invention in which an exclusive property or privilege is claimed are defined as follows:

1. A centrifugal water pump having a chamber;

an inlet means communicating with said chamber;

means for supporting said chamber and inlet means generally in a direction along a given plane;

an outlet means having an outlet port with a passageway means communicating with said chamber and extending generally perpendicular to said plane;

an impeller means having a plurality of blades positioned in said chamber and rotatably mounted in said chamber about an axis extending along the same general direction as said inlet and chamber;

means for rotating said impeller;

said chamber having a wall means surrounding said impeller means, a major wall portion of said wall means spaced from the outermost radial path of said impeller blades and a minor wall portion of said wall means being located immediately adjacent said path;

first and second spaced terminal walls formed at the terminal ends of said minor wall portion and extending between said major and minor wall portions and forming a barrier therebetween;

said first terminal wall being located adjacent said outlet port on the side thereof in the direction of rotation of said impeller blades and said second terminal wall being located at least ninety degrees (90°) from said first terminal wall in the direction of rotation of said propeller blades.

2. The centrifugal pump of claim 1 in which the impeller means includes a plurality of arcuate shaped blades spaced from each other with a central open space between said blades.

3. The centrifugal pump of claim 1 in which the major and minor wall portions are cylindrical and have a common axis; said impeller blades being rotatable about said axis.

4. A centrifugal water pump having a chamber;

an inlet means communicating with said chamber;

means for supporting said chamber and inlet means generally in a horizontal direction;

an outlet means having an outlet port with a passageway communicating with said chamber and extending generally upwardly of said chamber;

an impeller means having a plurality of blades positioned in said chamber and rotatably mounted in said chamber about an axis extending along the same general direction as said inlet and chamber;

means for rotating said impeller;

said chamber having a wall means surrounding said impeller means, a major wall portion of said wall means spaced from the outermost radial path of said impeller blades and a minor wall portion of said wall means being located immediately adjacent said path;

first and second spaced terminal walls formed at the terminal ends of said minor wall portion;

said first terminal wall being located adjacent said outlet port on the side thereof in the direction of rotation of said impeller blades and said second terminal wall being located at least ninety degrees (90°) from said first terminal wall in the direction of rotation of said propeller blades, said first terminal wall extending at an obtuse angle to the direction in which said outlet port extends.

5. The centrifugal pump of claim 4 in which the first and second walls are located with respect to each other at an angle of about thirty degrees (30°) from the vertical.

6. The centrifugal pump of claim 1 in which the impeller blades extend along the same direction as said chamber and inlet means, said blades being spaced from one another to provide a central open space between said blades.

7. A centrifugal water pump having a chamber;

an inlet means communicating with said chamber;

means for supporting said chamber and inlet means generally in a horizontal direction along a given axis;

an outlet means having an outlet port with a passageway communicating with said chamber and extending generally perpendicular to the axis of said chamber;

an impeller means having a plurality of blades positioned in said chamber and rotatable mounted in said chamber about an axis extending along the same general direction as said inlet and chamber, said impeller blades extending along the same direction as said chamber and inlet means, said blades being spaced from one another to provide a central open space between said blades;

means for rotating said impeller;

said chamber having a wall means surrounding said impeller means, a major wall portion of said wall means spaced from the outermost radial path of said impeller blades and a minor wall portion of said wall means being located immediately adjacent said path;

first and second spaced terminal walls formed at the terminal ends of said minor wall portion;

said first terminal wall being located adjacent said outlet port on the side thereof in the direction of rotation of said impeller blades and said second terminal wall being located at least ninety degrees (90°) from said first terminal wall in the direction of rotation of said propeller blades;

said inlet opening of said inlet means having a smaller diameter than the outermost radial path of said blades thereby forming a wall adjacent to but spaced from the ends of said blades through which air can pass and normally be recirculated by said blades to form air pockets, said first terminal wall of said minor wall portion breaking up said air pockets when so formed.

8. The centrifugal water pump of claim 1 in which the first terminal wall has a flat inclined surface directing the pumped medium into said outlet port.

9. In a centrifugal water pump having a generally cylindrical chamber adapted to be mounted with its axis extending in a horizontal direction and having an inlet opening at one end thereof;

an impeller means rotatably mounted in said chamber about a horizontal axis;

means located at the other end of said chamber for rotating said impeller means;

an outlet means having a passageway extending upwardly from said chamber;

said impeller means being adapted to draw water through said inlet opening and force it through said passageway out of said outlet means, the improvement comprising:

said chamber being formed of two concentric arcuate wall portions;

one arcuate wall portion having a radius substantially equal to the radius of the outermost radial path of said impeller means and the other arcuate wall portion having a radius greater than said radius of the outermost radial path; .

first and second spaced terminal walls extending between said arcuate wall portions at the ends of said wall portions forming a barrier therebetween;

said outlet means including an opening in said other arcuate wall portion forming an outlet port.

10. The centrifugal pump of claim 9 in which said first terminal wall is located adjacent said outlet means on the side thereof in the direction of rotation of said impeller means and said second terminal wall is located at least ninety degrees (90°) from said first terminal wall in the direction of rotation of said propeller means.

11. The centrifugal pump of claim 9 in which the impeller means includes a plurality of arcuate shaped blades spaced from each other with a central open space between said blades.

12. In a centrifugal water pump having a generally cylindrical chamber adapted to be mounted with its axis extending in a horizontal direction and having an inlet opening at one end thereof;

an impeller means rotatably mounted in said chamber about a horizontal axis;

means located at the other end of said chamber for rotating said impeller means;

an outlet means having a passageway extending upwardly from said chamber;

said impeller means being adapted to draw water through said inlet opening and force it through said passageway out of said outlet means; the improvement comprising:

said chamber being formed of two concentric arcuate wall portions;

one arcuate wall portion having a radius substantially equal to the radius of the outermost radial path of said impeller means and the other arcuate wall portion having a radius greater than said radius of the outermost radial path;

first and second terminal walls formed between said arcuate wall portions, said first terminal wall being located adjacent said outlet means on the side thereof in the direction of rotation of said impeller means and extending at an obtuse angle to the direction in which said outlet port extends, said second terminal wall being located at least ninety degrees (90°) from said first terminal wall in the direction of rotation of said propeller means;

said outlet means including an opening in said other arcuate wall portion forming an outlet port.

13. The centrifugal pump of claim 10 in which the first and second terminal walls are located with respect to each other at an angle of about thirty degrees (30°) from the vertical.

14. The centrifugal pump of claim 9 in which the impeller blades extend along the same direction as said chamber and inlet means, said blades being spaced from one another to provide a central open space between said blades.

15. The centrifugal pump of claim 14 in which the inlet opening of said inlet means is of smaller diameter than the outermost radial path of said blades thereby forming a wall adjacent to but spaced from the ends of said blades through which air can pass and normally be recirculated by said blades to form air pockets, said first terminal wall and said one arcuate wall portion breaking up said air pockets when so formed.

16. The centrifugal water pump of claim 9 in which the first terminal wall has a flat inclined surface directing the pumped medium into said outlet port.

17. The centrifugal pump of claim 3 in which the first terminal wall extends at an obtuse angle to the direction in which said outlet port extends.

18. The centrifugal pump of claim 17 in which the first and second walls are located with respect to each other at an angle of about thirty degrees (30°) from the vertical.

19. The centrifugal pump of claim 6 in which the inlet opening of said inlet means is of smaller diameter than the outermost radial path of said blades thereby forming a wall adjacent to but spaced from the ends of said blades through which air can pass and normally be recirculated by said blades to form air pockets, said first terminal wall of said minor wall portion breaking up said air pockets when so formed.

20. The centrifugal pump of claim 10 in which the first terminal wall extends at an obtuse angle to the direction in which said outlet port extends.

21. The pump of claim 1 in which a divider wall is located in said passageway, said wall extending lengthwise longitudinally of said passageway and dividing said passageway means into two passageway.

22. The pump of claim 21 in which said divider wall extends laterally across said passageway means in substantially along the same direction as said chamber and inlet means.

23. The pump of claim 4 in which a divider wall is located in said passageway, said wall extending lengthwise longitudinally of said passageway and dividing said passageway means into two passageways.

24. The pump of claim 22 in which said divider wall extends laterally across said passageway means in substantially along the same direction as said chamber and inlet means.

25. The pump of claim 7 in which a divider wall is located in said passageway, said wall extending lengthwise longitudinally of said passageway and dividing said passageway means into two passageways.

26. The pump of claim 25 in which said divider wall extends laterally across said passageway means in substantially along the same direction as said chamber and inlet means.

27. The pump of claim 9 in which a divider wall is located in said passageway, said wall extending lengthwise longitudinally of said passageway and dividing said passageway means into two passageways.

28. The pump of claim 27 in which said divider wall extends laterally across said passageway means in substantially along the same direction as said chamber and inlet means.

29. The pump of claim 12 in which a divider wall is located in said passageway, said wall extending lengthwise longitudinally of said passageway and dividing said passageway means into two passageways.

30. The pump of claim 29 in which said divider wall extends laterally across said passageway means in substantially along the same direction as said chamber and inlet means.

* * * * *